United States Patent [19]

Stanley et al.

[11] Patent Number: 4,971,685

[45] Date of Patent: Nov. 20, 1990

[54] BUBBLE INJECTED HYDROCYCLONE FLOTATION CELL

[75] Inventors: Donald A. Stanley; Cy E. Jordan, both of Tuscaloosa, Ala.

[73] Assignee: The United States of America as represented by the Secretary of the Interior, Washington, D.C.

[21] Appl. No.: 336,168

[22] Filed: Apr. 11, 1989

[51] Int. Cl.[5] ..... B03D 1/14; B03D 1/24; B04C 5/04

[52] U.S. Cl. ..... 209/170; 209/211; 209/164; 210/512.1

[58] Field of Search ..... 209/170, 211, 164; 210/703, 221.2, 512.1, 512.2

[56] References Cited

U.S. PATENT DOCUMENTS

| | | | |
|---|---|---|---|
| 3,557,956 | 1/1971 | Brown | 209/170 |
| 4,279,743 | 7/1981 | Miller | 209/170 |
| 4,397,741 | 8/1983 | Miller | 209/170 |
| 4,696,737 | 9/1987 | Bouchillon | 209/211 |
| 4,744,890 | 5/1988 | Miller | 209/170 |
| 4,838,434 | 6/1989 | Miller | 209/170 |

FOREIGN PATENT DOCUMENTS

| | | | |
|---|---|---|---|
| 657856 | 4/1979 | U.S.S.R. | 209/170 |
| 1263363 | 10/1986 | U.S.S.R. | 209/211 |
| 1353512 | 11/1987 | U.S.S.R. | 209/211 |
| 8607548 | 12/1986 | World Int. Prop. O. | 209/211 |

*Primary Examiner*—David L. Lacey
*Assistant Examiner*—Thomas M. Lithgow
*Attorney, Agent, or Firm*—E. Philip Koltos

[57] ABSTRACT

A method and apparatus for selectively separating a mixture of hydrophobic and hydrophilic mineral particles. A mineral pulp is prepared which includes minerals ground to a predetermined size. A bubble slurry is then prepared which includes a gas entrained in a liquid to form bubbles of a predetermined size. The mineral pulp and bubble slurry are simultaneously injected into the cell apparatus. The cell has an enclosed body with a feed receiving portion, a narrowed apex portion with an underflow discharge, and an intermediately disposed merger zone. A mineral pulp feed port extends into and is directed tangentially to the feed receiving portion in the mineral pulp feed zone. The bubble slurry feed port, disposed in the same direction as the mineral pulp feed port, extends into and is directed tangentially to the feed receiving portion in the bubble slurry zone. A vortex finder, having a tubular member which has one end extending exterior of the feed receiving portion and another end extending into the merger zone, is attached to and extends axially of the feed receiving portion. The mineral pulp and the bubble slurry merge in the merger zone, hydrophobic particles form a froth and exit through the vortex finder, and the hydrophilic particles exit through the underflow discharge, thereby separating the mixture mineral particles.

19 Claims, 1 Drawing Sheet

BUBBLE INJECTED HYDROCYCLONE FLOTATION CELL

TECHNICAL FIELD

This invention relates to methods and equipment for minerals beneficiation, and more particularly to a method and apparatus for recovery of values from lower grade ores and ores that must be ground to small particle sizes to obtain mineral liberation.

BACKGROUND ART

Presently available methods for recovery of values from lower grade and finely ground ore include froth flotation and hydrocyclone classification. Froth flotation is the attachment of mineral particles and air bubbles in an aqueous media, the transportation of the mineral-bubble aggregates into the froth phase, and the physical separation of the froth from the aqueous mineral slurry. Selective separation of minerals by froth flotation can be obtained by utilizing the hydrophobic or hydrophilic surface properties of the minerals. Hydrophobic minerals attach to bubbles upon collision whereas hydrophilic minerals do not attach to bubbles. Flotation reagents are used to enhance or establish these surface properties. Activator and collector reagents are used to make hydrophobic mineral surfaces and depressant reagents are used to make hydrophilic mineral surfaces. By judicious use of flotation reagents, selective flotation separation of minerals can be accomplished. The conventional flotation cell is basically a stirred-tank with provisions for injecting air as small bubbles. The top of the flotation cell is usually open allowing the mineral laden froth to form and be removed from the cell. Flotation is used almost universally in the minerals industry to beneficiate copper, lead, zinc, iron, phosphate, potash, coal, and many other mineral systems. [See, Ahmed, N. and Jameson, G. J., 1985, "The Effect of Bubble Size on the Rate of Flotation of Fine Particles," *International Journal of Mineral Processing*, vol. 14, Elsevier Science Publishing Co., pp. 195–215; Jowett, A., "Formation and Distruption of Particle-Bubble Aggregates in Flotation", *Fine Particles Processing*, Editor, P. Somasundaran, SME-AIME, Volume 1, p. 720, February, 1980; Kelley, E. G. and Spottiswood, D. J., 1982, "*Introduction to Mineral Processing*", John Wiley and Sons; and Trahar, W. J. and Warren, L. J., 1976, "The Floatability of Very Fine Particles—A Review", *International Journal of Mineral Processing*, vol. 3, pp. 103–131.]

Hydrocyclones are used universally by the minerals industry for classifying particles by size or density. The swirling flow of the pulp creates centrifugal forces that rapidly accelerate the particles to the peripheral of the hydrocyclone chamber. Coarse particles and/or high density particles quickly move through the fluid and exit through the apex. The fine and/or light particles move slower and are swept into the vortex and removed through the vortex finder. By adjusting the flowrate, hydrocyclone diameter, vortex finder diameter, and apex diameter, a size or density separation can be made.

An "air-sparged hydrocyclone" was developed and patented by J. D. Miller, that combined a hydrocyclone with flotation. [See, U.S. Pat. No. 4,279,743 issued July 21, 1981 to J. D. Miller, "Air-Sparged Hydrocyclone and Method"; Miller, J. D., "The Concept of an Air-Sparged Hydrocyclone", AIME Annual Meeting, Chicago, February 1981; and Miller, J. D., and VanCamp, M. C., "Fine Coal Cleaning with an Air Sparged Hydrocyclone", AIChE National Meeting, paper number 62b, Houston, April 1981.] Like a hydrocyclone, the mineral pulp is injected tangentially, but the air is forced through the porous walls of the hydrocyclone interior. The bubbles move to the hydrocyclone vortex gathering hydrophobic particles and forming a mineral laden froth that exits through the vortex finder. The hydrophilic minerals do not attach to the bubbles and exit through the cyclone apex. Several effective flotation separations have been made with this device.

A major design limitation of the air-sparged hydrocyclone is that bubble size is difficult to control. Bubble size is fundamentally determined by the surface velocity of the pulp which shears the bubble from the pore openings. However, the slowest velocity within the hydrocyclone occurs at the porous interior walls. This low velocity leads to relatively large bubbles (approximately 1 mm diameter size). These bubbles have a low probability for collision with the fine mineral particles (less than 10 μm size). To increase the collision probability for fine size mineral particles, either more bubbles, smaller bubbles, or higher shear velocities are needed. Unfortunately, more air leads to bigger bubbles. At increased pulp flowrates, the shear velocity increases making smaller bubbles, but the concentration of bubbles declines because the flowrate has increased. To a large extent, the smallest bubble size is fixed by the basic design of the air-sparged hydrocyclone and cannot be lowered without decreasing the bubble-particle collision probability.

Those concerned with these and other problems recognize the need for an improved mineral separation apparatus and method.

DISCLOSURE OF THE INVENTION

The present invention provides a method and apparatus for selectively separating a mixture of hydrophobic and hydrophilic mineral particles. A mineral pulp is prepared which includes minerals ground to a predetermined size. A bubble slurry is then prepared which includes a gas entrained in a liquid to form bubbles of a predetermined size. The mineral pulp and bubble slurry are simultaneously injected into the cell apparatus. The cell has an enclosed body with a feed receiving portion, a narrowed apex portion with an underflow discharge, and an intermediately disposed merger zone. A mineral pulp feed port extends into and is directed tangentially to the feed receiving portion in the mineral pulp feed zone. The bubble slurry feed port, disposed in the same direction as the mineral pulp feed port, extends into and is directed tangentially to the feed receiving portion in the bubble slurry zone. A vortex finder, having a tubular member which has one end extending exterior of the feed receiving portion and another end extending into the merger zone, is attached to an extends axially of the feed receiving portion. The mineral pulp and the bubble slurry merge in the merger zone, hydrophobic particles form a froth and exit through the vortex finder, and the hydrophilic particles exit through the underflow discharge, thereby separating the mixture of mineral particles.

There are two major advantages of the bubble-injected hydrocyclone flotation cell over the "air-sparged hydrocyclone". First, independent control of bubble size is provided by external bubble generation.

In the "air-sparged hydrocyclone", the bubble size was controlled by the pore size of the porous wall, the air flow rate, and the flowrate of the mineral slurry. The narrow size distribution of bubbles from the "air-sparged hydrocyclone" may not be optimum for an ore containing a wide size range of ore particles. With externally generated bubbles, their size distribution can be adjusted to transport the large particles without sacrificing the floatability of the smaller particles. In addition, bubbles of two appropriate sizes can be generated externally and combined for injection into the apparatus with each bubble size appropriate to a range of particle sizes. The bubble-injected hydrocyclone flotation cell allows independent control of the bubble sizes because the bubbles are generated outside the flotation cell. The second advantage is that the tangential injection of the bubble slurry does not significantly disturb the hydrocyclone flow and allows significantly higher relative velocities between the particles and bubbles. The higher relative velocity increases the collision probability between the bubble and particle and subsequently increases the flotation kinetics.

The air-sparged hydrocyclone must be constructed from a large diameter porous metal or ceramic cylinder which is both expensive and difficult to fabricate. External generation of air bubbles means that flotation cyclones can be fabricated of inexpensive non-porous materials. If the pores in an air-sparged hydrocyclone become obstructed, it may be necessary to replace the entire cyclone. With the air-injected hydrocyclone, it is only necessary to replace the external bubble generator which can be accomplished without removing the cyclone from service.

The fundamental equations for bubble-particle collision efficiency in flotation indicated that smaller bubbles and higher bubble-particle relative velocities significantly improve flotation rate. Small bubbles in a conventional flotation cell were shown to have lower bubble-particle relative velocities than large bubbles. However, under the influence of high centrifugal forces, the relative velocity of small bubbles was increased significantly. An "air-sparged hydrocyclone" could be used to create the high centrifugal force, but the bubble size could not be easily controlled. An external bubble generator provides independent control of the bubble size and an additional tangential feed port on a hydrocyclone positions the bubbles for effective collection of the hydrophobic particles. This line of reasoning led to the conception and design of the bubble-injected hydrocyclone flotation cell.

An object of the present invention is the provision of an improved bubble-injected hydrocyclone flotation cell that may be used by the minerals industry for flotation of hydrophobic particles or ions from aqueous media.

Another object of the present invention is to provide an improved mineral separation apparatus and method that yields a high capacity per unit volume without mechanical agitation.

A further object of the invention is the provision of an improved mineral separation apparatus and method that may be utilized virtually anywhere conventional flotation cells are used in the mineral beneficiation industry.

Still another object of the present invention is to provide an improved mineral separation apparatus and method that permits recovery of values from domestic lower grade ores and from ores that must be ground to very small particle size to obtain mineral liberation.

A still further object of the present invention is the provision of an improved mineral separation apparatus and method that will reduce capital costs for future flotation plants by providing high throughput per unit volume.

Yet another object of the present invention is the provision of an improved mineral separation apparatus and method that can be used as an alternative to conventional flotation cells.

A further object of the present invention is the provision of an improved mineral separation apparatus and method that is suited for the flotation of ultrafine mineral particles that are not efficiently recovered by conventional flotation apparatus.

Yet a further object of the present invention is the provision of an improved mineral separation apparatus and method that will generate external bubbles and provide independent control of bubble size in the bubble-injected hydrocyclone flotation cells.

Still a further object of the present invention is the provision of an improved mineral separation apparatus and method that will yield smaller bubbles and enhance the bubble particle collision probability and result in better flotation recovery of ultrafine materials.

A further object of the present invention is the provision of an improved mineral separation apparatus and method that uses dual feed ports, one for the conditioned mineral slurry and the other for the bubble slurry.

A still further object of the present invention is the provision of an improved mineral separation apparatus and method that will tangentially inject the bubble slurry into the hydrocyclone.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

Figure 1:
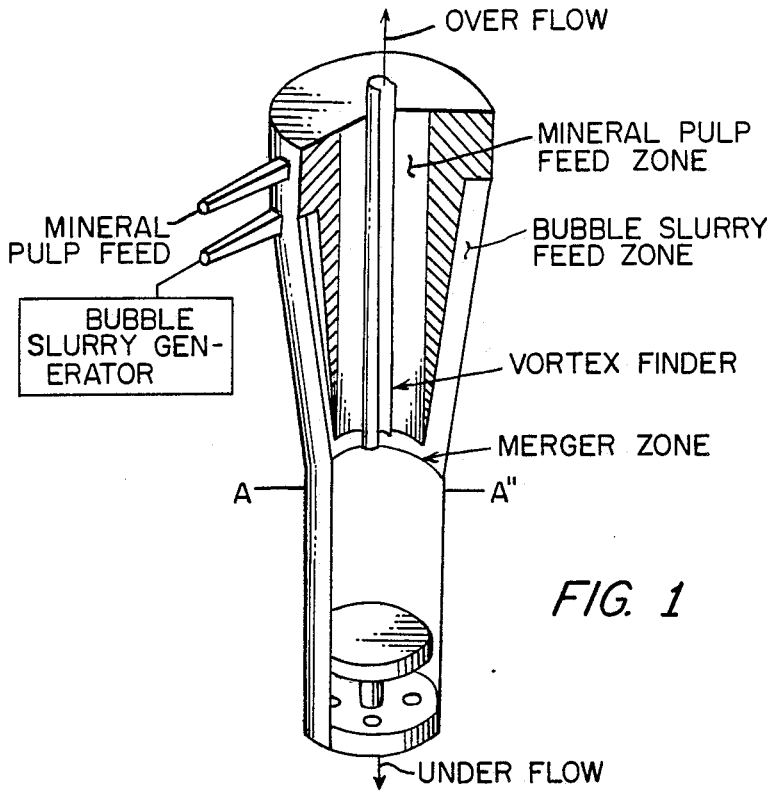
FIG. 1 is a cut away perspective view showing the air-injected hydrocyclone flotation cell with the tangential bubble slurry feed channel and the ring apex.

The bubble injected hydrocyclone flotation cell is a simple classifier hydrocyclone with an additional tangential feed port for injecting bubbles suspended in an aqueous media. Two methods of bubble injection are disclosed to explain the concept. In FIG. 1, the bubble slurry is injected tangentially at the peripheral of the hydrocyclone's interior. The swirling action of the fluid and bubbles generate centrifugal forces that quickly move the bubbles toward the hydrocyclone vortex. The conditioned mineral pulp is also injected tangentially and in the same rotation direction as the bubble slurry.

However, the mineral slurry is injected in a central cylinder within the hydrocyclone interior. The centrifugal forces generated by the swirling slurry quickly move the particles toward the hydrocyclone peripheral. Below both the bubble and mineral feed ports, the inner and outer flows gradually merge in the hydrocyclone. Beyond this point, the bubbles move through the mineral slurry, gather hydrophobic particles, form a froth at the hydrocyclone vortex, and exit through the vortex finder. The hydrophilic particles move through the swarm of bubbles, proceed to the peripheral of the hydrocyclone interior, and exit through the hydrocyclone's ring apex.

Figure 2:
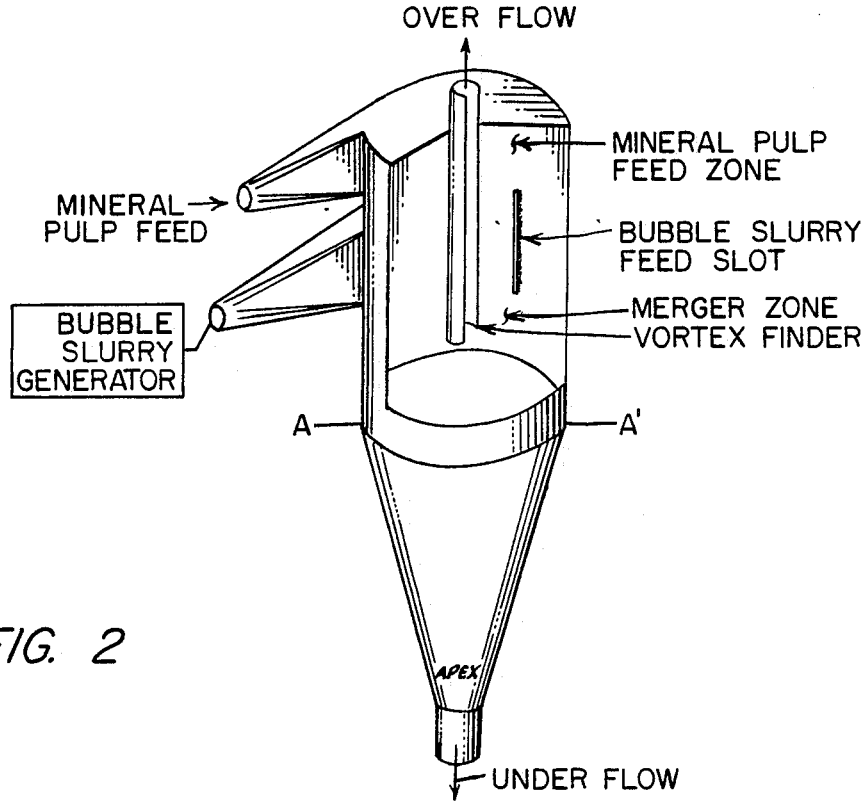
FIG. 2 is a cut away perspective view showing the air-injected hydrocyclone flotation cell with the tangential bubble slurry feed slot and the conical apex.

The second method of bubble injection is shown in FIG. 2. Here the bubble slurry is injected tangentially through a very narrow slot in the peripheral wall of the hydrocyclone interior. The long axis of the slot runs parallel to the hydrocyclone axis. The mineral slurry is injected in the conventional manner at a position above the bubble slurry feed slot. In this way, the mineral slurry must move through the swarm of bubbles emanating from the bubble slurry feed slot. The hydrophobic particles attach to the bubbles, move to the hydrocyclone vortex, form a froth, and exit the hydrocyclone through the vortex finder. The hydrophilic particles move through the bubble swarm and exit through the hydrocyclone apex. The upper portion of the two bubble-injected hydrocyclone flotation cell design examples shown in FIGS. 1 and 2 are interchangeable with the lower portions below the A–A' horizontal cross-sectional plane in both figures. The key feature of the air-injected hydrocyclone flotation cells is the tangential injection of the bubbles so that the mineral slurry must move through a bubble swarm before exiting through the hydrocyclone apex.

The hydrocyclone flotation cell dimensions are adjustable according to accepted practice for hydrocyclone classification design. The flowrate and hydrocyclone diameter are adjusted to insure adequate particle residence time within the hydrocyclone's interior for the high centrifugal forces to move all the particles (especially the fine particles) to the hydrocyclone peripheral wall. In this manner, the hydrophilic particle will be efficiently recovered in the hydrocyclone underflow and allow only the floated hydrophobic particles to leave through the vortex finder with the overflow froth. The vortex finder for both hydrocyclone flotation cell designs is positioned below the merging region shown in FIG. 1 and the bubble slurry feed slot shown in FIG. 2. The diameter of the vortex finder is adjustable to balance the flow of the froth with the feed rates. The ring apex dimensions (FIG. 1) and the apex diameter (FIG. 2) are also adjustable to balance the underflow rate with the feed rates.

The bubbles can be generated in an aqueous media by a variety of techniques described in the literature. (1) Air forced through a fine pore size media can be used to form bubbles in the water. The bubble size is controlled by the pore size and shear agitation at the pore opening. (2) Dissolved air in water under pressure can be used to form bubbles. When the high pressure water encounters the low pressure in the hydrocyclone, the dissolved gas is released from solution to form small bubbles. Bubble size can be controlled by regulating the pressure of the fluid entering the hydrocyclone. (3) A small jet nozzle can be used to form bubbles by injecting a mixture of water and air under pressure. The bubbles form at the jet opening and their size can be regulated with the jet hole size and the air/water ratio. (4) Mechanical bubble generates can be used similar to conventional flotation cells employing an impellor and stator design to break-up the air into fine bubbles. There are several variations on these bubble generators that provide a variety of bubble sizes. (5) Also, a high speed rotating disk in water could be used to generate fine size bubbles. Any of the above mentioned techniques can be used to generate bubbles for the hydrocyclone flotation cell. A frother reagent is used to help stabilize the bubbles long enough to pump them into the bubble-injected hydrocyclone flotation cell. The independent bubble generator, separate from the bubble-injected hydrocyclone flotation cell, allows bubble size control without altering the flow characteristics within the bubble-injected hydrocyclone flotation cell.

The dimensions of the hydrocyclone interior, diameter and length, feed ports, vortex finder, and apex are adjustable, but they are generally defined by established hydrocyclone design principles. The physical nature of the mineral slurry and the bubble slurry are considered before selecting a particular set of design characteristics. For example, fine particles and small bubbles require a small diameter air-injected hydrocyclone flotation cell with small feed ports. The small radius of curvature and the high velocities obtained through the small feed ports generate the high centrifugal forces that are required to separate the fine hydrophilic particles from the fine bubbles laden with the fine hydrophobic particles.

EXAMPLE 1

Mineral separations were made using finely ground chalcopyrite ore containing 0.5 percent copper. A conventional flotation cell was used to generate bubbles having a mean diameter of 350 μm and with 80 percent of the bubbles between 180 and 575 μm size. The bubble slurry injected into the hydrocyclone was approximately 25 percent air. The minus 38 μm size chalcopyrite ore slurry was adjusted to 25 percent solids before feeding it to the hydrocyclone flotation cell. Over 87 percent of the copper was recovered in a single pass through the hydrocyclone. The residence time in the hydrocyclone was only 0.3 seconds as compared to 300 seconds in a conventional flotation cell. This short residence time in the hydrocyclone produced a 1,000 fold increase in the chalcopyrite flotation rate with about the same copper recovery as the conventional flotation cell.

EXAMPLE 2

The system was tested with fine ground quartz having an 18 μm mean particle size and 80 percent of the quartz between 4 and 29 μm size. At 20 mL/s mineral slurry and 140 mL/s bubble slurry, only 2 percent of the quartz floated in the hydrocyclone flotation cell without collector. After conditioning with amine, 53 percent of the quartz was floated in the hydrocyclone with the conventional size bubbles and 75 percent of the quartz was recovered with the fine size bubbles. This clearly shows the improved flotation response with fine bubbles. In a conventional laboratory flotation cell the amine conditioned quartz was 100 percent floated. These results can be explained with the laminar flow flotation model. Within the hydrocyclone, the relative velocity of the particles and bubbles increased over 100 times. This also increased the bubble-particle collision probability by over 100 times, which directly increased the flotation rate by over 100 times. However, the first order flotation equation indicated that the flotation recovery was exponentially proportional to the negative product of the flotation rate constant times the flotation residence time.

$$\text{Flotation Recovery} = 1 - \Sigma_p f_p e - \Sigma_b f_b K_{pb} t$$

where $\Sigma_p$ = the summation of all the particle sizes, $f_p$ = the fraction of the weight as $d_p$ size particles $\Sigma_b$ = the summation of all the bubble sizes, $f_b$ = the fraction of the air as $d_b$ size bubbles, $K_{pb}$ = the rate constant for a $d_p$ size particle and a $d_b$ size bubble, and t = the time of flotation.

The residence time within the hydrocyclone was only 0.3 seconds whereas, in a conventional flotation cell approximately 300 seconds residence time was required to achieve 100 percent flotation of the amine conditioned quartz. Therefore, the residence time in the hydrocyclone was 1,000-fold less than the conventional cell and this large difference could account for the lower quartz recovery. This is especially true if the induction time is a major factor in the flotation sequence. There are several approaches available to increase the residence time within the hydrocyclone. First, a two-stage or three-stage hydrocyclone system could be employed to increase the flotation recovery of the hydrophobic particles. Second, the inlet pressure apex diameter, and vortex finder diameter could be optimized for this 2.5-cm-diameter hydrocyclone. Third, the hydrocyclone diameter could be increased to increase the flotation residence time. All of these approaches should improve the flotation residence time and improve the flotation response of the fine bubble, hydrocyclone flotation cell.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

We claim:

1. An apparatus for selective separation of a mixture of hydrophobic and hydrophilic mineral particles, said apparatus comprising, in combination:

a bubble-injected hydrocyclone flotation cell and a bubble slurry generating means; said cell comprising:

an enclosed body section defining a first zone having a bubble slurry feed receiving region and a mineral pulp feed receiving region, a merger zone located axially below said first zone, and a further zone located axially below said merger zone and including an underflow discharge;

a mineral pulp feed port extending into and directed tangentially to said mineral pulp feed receiving region for feeding a mineral pulp to said mineral pulp feed receiving region;

a bubble slurry feed port connected to said bubble slurry generating means and extending into and directed tangentially to said bubble slurry feed receiving region, for feeding a bubble slurry from said bubble slurry generating means to said bubble slurry feed receiving region; said bubble slurry feed port being disposed in the same direction as said mineral pulp feed port; and a vortex finder attached to and extending axially within said mineral pulp feed receiving region, said vortex finder including a tubular member having one end extending exterior of said enclosed body section and having another end extending into said merger zone.

2. The apparatus of claim 1 wherein said mineral pulp feed port is disposed above said bubble slurry feed port.

3. The apparatus of claim 1 wherein said mineral pulp feed receiving region comprises a substantially cylindrical annular volume disposed between said vortex finder and said bubble slurry feed receiving region and wherein said mineral pulp feed port extends into said substantially cylindrical annular volume.

4. The apparatus of claim 1 wherein said bubble slurry generating means comprises means for forcing air through fine pore size media.

5. The apparatus of claim 1 wherein said bubble slurry generating means comprises means for dissolving air in water under pressure.

6. The apparatus of claim 1 wherein said bubble slurry generating means comprises a jet nozzle for injecting an air-water mixture.

7. The apparatus of claim 1 wherein said bubble slurry generating means comprises a mechanical bubble generator.

8. The apparatus of claim 2 wherein said bubble slurry generating means comprises a high speed rotating disk in water.

9. A method of selectively separating a mixture of hydrophobic and hydrophilic mineral particles, said method comprising the steps of:

preparing a mineral pulp including minerals ground to a predetermined particle size;

preparing a bubble slurry including a gas entrained in a liquid to form bubble of a predetermined size;

simultaneously injecting said mineral pulp and said bubble slurry into a bubble-injected hydrocyclone flotation cell comprising:

an enclosed body section defining a first zone having a bubble slurry feed receiving region and a mineral pulp feed receiving region, a merger zone located axially below said first zone, and a further zone located axially below said merger zone and including an underflow discharge;

a mineral pulp feed port extending into and directed tangentially to said mineral pulp feed receiving region for feeding said mineral pulp to said mineral pulp feed receiving region;

a bubble feed port extending into and directed tangentially to said bubble slurry feed receiving region for feeding said bubble slurry to said bubble slurry feed receiving region; said bubble slurry feed port being disposed in the same direction as said mineral pulp feed port; and a vortex finder attached to and extending axially within said mineral pulp feed receiving region, said vortex finder including a tubular member having one end extending exterior of said enclosed body portion and having another end extending into said merger zone;

wherein said mineral pulp and said bubble slurry merge in said merger zone, hydrophobic particles form a froth and exit through the vortex finder, and hydrophilic particles exit through the underflow discharge, thereby separating the mixture of mineral particles.

10. The method of claim 9 wherein said mineral pulp feed port is disposed above said bubble slurry feed port.

11. The method of claim 9 wherein said feed receiving region comprises a substantially cylindrical annular volume disposed between said vortex finder and said bubble slurry feed receiving region and wherein said mineral pulp feed port extends into said substantially cylindrical annular volume.

12. The method of claim 9 wherein said bubble slurry feed port is an elongated slot having a long axis disposed parallel to a long axis of said vortex finder.

13. The method of claim 9 wherein said bubble slurry is prepared in a bubble generator independent of said cell.

14. The method of claim 13 wherein said bubble slurry is prepared by forcing air through fine pore size media.

15. The method of claim 13 wherein said bubble slurry is prepared by dissolving air in water under pressure.

16. The method of claim 13 wherein said bubble slurry is prepared by injecting an air-water mixture through a jet nozzle.

17. The method of claim 13 wherein said bubble slurry is prepared by a mechanical bubble generator.

18. The method of claim 13 wherein said bubble slurry is prepared by a high speed rotating disk in water.

19. The method of claim 13 further including the step of adding a frother reagent to the bubble slurry to stabilize the bubble slurry after generation and before injection into the bubble-injected hydrocyclone flotation cell.

* * * * *